United States Patent [19]

Fishter et al.

[11] Patent Number: 4,534,823

[45] Date of Patent: Aug. 13, 1985

[54] CHEMICAL MILLING IN-100 NICKEL SUPERALLOY

[75] Inventors: Robert E. Fishter, Boca Raton; Paul L. McDaniel, Hobe Sound, both of Fla.; Stephen W. Tefft, Houston, Tex.

[73] Assignee: United Technologies Corporation, Hartford, Conn.

[21] Appl. No.: 558,415

[22] Filed: Dec. 5, 1983

[51] Int. Cl.[3] ..... C23F 1/00; B44C 1/22; C03C 15/00; C03C 25/06

[52] U.S. Cl. ..... 156/626; 134/3; 156/654; 156/664; 252/79.2; 252/79.3; 252/79.4

[58] Field of Search ..... 156/626, 654, 656, 659.1, 156/664; 252/79.2, 79.3, 79.4; 134/3

[56] References Cited

U.S. PATENT DOCUMENTS 3,975,245 8/1976 Berquist et al. ..... 204/129.95

4,247,377 1/1981 Eckler et al. ..... 204/129.65

4,339,282 7/1982 Lada et al. ..... 134/3

4,353,780 10/1982 Fishter et al. ..... 156/664

*Primary Examiner*—William A. Powell

*Attorney, Agent, or Firm*—C. G. Nessler

[57] ABSTRACT

Chemical milling of the commercial gamma-gamma prime nickel superalloy IN-100 is carried out by using an aqueous solution comprised of 32.5–85 volume percent HCl, with other ingredients proportioned on the HCl, preferably 40 ml/l nitric acid, 0.0141 M/l metal sulfate ion, 0.0326 M/l metal chloride ion, 0.0168 M/l alkali metal ion and 0.0073 M/l citric acid. The chemical milling is particularly effective in uniformly removing a small amount of surface layer without any deleterious attack. It hereby is useful to improve the effectiveness of surface penetrant inspection, to find small flaws which would otherwise be concealed by a worked surface layer.

7 Claims, No Drawings

CHEMICAL MILLING IN-100 NICKEL SUPERALLOY

TECHNICAL FIELD

The invention relates to chemical milling of nickel base superalloys, most particularly to the removal of a surface layer from a machined article, as part of an inspection process for surface defects.

BACKGROUND

Wrought nickel superalloys of the gamma-gamma prime type are widely used in modern gas turbines. One such particular component is the disk in the turbine section which rotates at high speeds and elevated temperature. The disk is subjected to very high stresses and has a great amount of stored energy. It must therefore be designed and fabricated in a manner which avoids failure to the greatest extent possible. Naturally, only the finest materials and most careful processing are used. Repetitive inspections to the highest technical level possible are used to ensure quality.

Of particular concern is the possibility of minute surface cracks which can propagate over time and result in metal fatigue failure. Therefore, various surface inspection procedures are used to find such minute cracks, including ultrasonic, eddy current and fluorescent penetrant inspection (FPI) techniques. Defects which are located within about 1.3 mm of the surface of such articles are especially difficult to find. Eddy current and fluorescent penetrant inspection are preferred. And since it is well known that all these processes have their advantages, disadvantages and reliability limits, it is not uncommon that a critical article such as a gas turbine disk be subjected to redundant inspections.

Those familiar with inspection technology are well aware that the degree of uncertainty rises when the limits of detectability are approached. Yet, it is highly undesirable that costly components be discarded because of a spurious inspection signal. Consequently, confirmation is generally sought between the independent methods.

In the particular instance of inspecting articles made of the nickel alloy IN-100 (an alloy of Inco, Ltd, New York), problems have been encountered in obtaining such verification. For example, eddy current inspection may indicate the presence of a flaw, whereas there will not be the expected confirmation from FPI. Experimental work has shown that this can be attributable to the smearing over of minute cracks on the metal surface due to conventional machining. When the exposed surface of a crack has metal smeared across it, then the fluorescent penetrant cannot enter the crack, and there is no confirmation.

Therefore, the problem has been how to best improve the present methods of inspection.

DISCLOSURE OF THE INVENTION

An object of the invention is to improve the techniques of fluorescent penetrant inspection, but to make such improvements in an economic way, and in a manner which does not have any adverse metallurgical affect on the structure being inspected. A further object of the invention is to provide a chemical etchant which removes a smeared metal surface layer from alloy IN-100 articles in a benign manner.

According to the invention, a nickel alloy essentially IN-100 (which in a wrought form is nominally by weight percent 12.4Cr, 18.5Co, 0.07C, 4.3Ti, 5.0Al, 3.2Mo, balance Ni, with small amounts of V, Zr and B) is milled in controllable fashion without intergranular attack or substantial selective attack of particular phases by contacting it with an aqueous solution consisting essentially of 32.5–85 volume percent hydrochloric acid, preferably 32.5–42.5 percent, with other ingredients proportioned on the volume of hydrochloric acid; namely, 35–45 ml/l nitric acid; 0.0122–0.0160 mole/liter of metal sulfate ion; 0.0283–0.0369 mole/liter of metal chloride ion; 0.0146–0.0190 mole/liter of metal fluoride ion and 0.0063–0.0083 mole/liter of citric acid. Water makes the balance of the solution.

A preferred solution is by volume percent 37.5HCl and 1.5$HNO_3$ with which are included (based on volume of HCl) 2.25 g/l $CuSO_4$, 1.76 g/l $FeCl_3$, 0.704 g/l NaF, and 1.41 g/l citric acid. The balance of the solution, about 61 volume percent, is water. Dilute solutions are suited for slow but steady removal, while concentrated solutions are more agressive. A preferred operating temperature is 55°–60° C.

Best Mode for Carrying Out the Invention

The primary objective of the present invention is accomplished by chemical milling of the surface of the article prior to conducting a fluorescent penetrant inspection. However, it will be apparent that the invention may be used in other instances where it is desired to remove by chemical means portions of the surface of a nickel superalloy essentially equivalent to the alloy IN-100.

Dye penetrant inspection procedures are well known in industry. Generally, a low viscosity material is infiltrated into a crack or other flaw on the surface of a material by contacting the surface with the penetrant. Surplus penetrant is removed and observation is then made of residual material which seeps from surface flaws, thereby revealing their presence. When the component being inspected is viewed under ultra-violet light and the residual penetrant oil is one which fluoresces, flaws become especially visible by virtue of the contrast between the penetrant and the darker surface of the component. It will be appreciated with the further description herein that the invention will be useful for any inspection procedure wherein a liquid or gas is infiltrated into the surface flaws.

The present invention is useful with the commercial alloy called IN-100. This alloy is an age-hardenable nickel base superalloy of the gamma-gamma prime type and it comes in various chemical modifications and forms, such as extrusions, forgings and castings. The IN-100 extrusion alloy consists by weight percent of 11.90 to 12.90Cr, 18.00 to 19.00Co, 0.05 to 0.09C, 4.15 to 4.50Ti, 4.80 to 5.15Al, 2.80 to 3.60Mo, 0.58 to 0.98V, 0.016 to 0.024B, 0.04 to 0.08Zr, balance Ni. There are limitations on the maximum amounts of other ingredients when the alloy is used in critical applications, e.g., maximum weight percents are 0.02Mn, 0.1Si, 0.01S, 0.01P, 0.05W, 0.04 Ta+Nb, 0.3Fe, 0.07Cu; 2 ppm Pb, 0.5 ppm Bi and 100 ppm oxygen. The etching solution described herein has been found to work on cast and wrought IN-100. In contrast, it has been found to not work effectively (within the context of this specification) on the commercial wrought alloys IN-718 (19Cr, 0–10C, 18Fe, 0.9Ti, 0.6Al, 3Mo, 5.2 (Cb+Ta), balance Ni) and Waspaloy (19.5Cr, 13.5Co, 0.08C, 3Ti, 1.4Al, 4Mo, 0.08Zr, 0.007B, balance Ni). Of course those familiar with superalloy art will recognize that there are significant differences in morphology and structural strength between the aforementioned alloys even though their compositions do not seem that variant to the incognizant. Therefore, our solution and process is specific for alloys which are essentially of the composition of IN-100 and its variants.

While there are many chemical agents which will attack the surface of the IN-100 alloy, the problem in the present invention is to remove material from the surface without either intergranular attack (IGA) or selective localized attack of particular metallurgical features. IGA tends to weaken the component, particularly where it is used in high stress applications leading to creep or fatigue failure. Selective attack means that one phase, most often gamma prime, is preferentially attacked with or without pitting and gouging, with a result that the material has an uneven surface. Selective attack is also deleterious.

A number of etchants were investigated and characterized for their effect on wrought IN-100 alloy, as recited in Table 1. These etchants include those which have been found useful for other nickel base alloys. Etchants 19 and 20 (the latter being a diluted version of the former) are particular species which have been found useful, compared to all the others which suffered either the inability to attack the metal generally, or a deleterious mode of attack. A review of the Table will show that the ratio of HCl to $HNO_3$ must be high to get the desired etching (compare 19 with 8–13), but if it is too high the milling action ceases; that NaF and citric acid must be present to avoid selective attack (compare 19 with 18 and 15); that citric acid must be in a certain ratio to NaF to avoid selective attack (compare 19 with 17); etc.

TABLE 1

Effect of Experimental Solutions on IN-100 Alloy

| | Liquid Ingredients - Volume % | | | | Solid Ingredients - Grams/liter of liquid | | | | | | | |
|---|---|---|---|---|---|---|---|---|---|---|---|---|
| | HCl | $HNO_3$ | $H_2O$ | Other | $FeCl_3$ | $CuSO_4$ .$5H_2O$ | NaF | Citric Acid | Other | IGA | SA | Other |
| 1* | 43.4 | 12.1 | 18.1 | 18.1 Acetic Acid 3.6 $H_2SO_4$ | 109 | | | | | | H | |
| 2 | 71.7 | 6.0 | 9.0 | 9.0 Acetic Acid 1.8 $H_2SO_4$ | 54 | | | | | | H | |
| 3** | 50 | | | 50 Ethanol | | | | | 25 $CuCl_2$ | | | No Effect |
| 4 | | 40 | 58 | 2 HF | | | | | | H | | |
| 5 | 80 | 2 | 11 | | 162 | | | | | H | | |
| 6 | 100 | | | | | | | | | | | No Effect |
| 7 | 95 | | | 5 HF | | | | | | | H | |
| 8 | 5 | 50 | 45 | | 1.32 | 2.64 | | | | | | No Effect |
| 9 | 5 | 50 | 45 | | 1.32 | 2.64 | 2.64 | | | M | | |
| 10 | 3 | 50 | 47 | | 1.32 | 2.64 | 2.64 | | | M | | |
| 11 | 3 | 50 | 47 | | 1.32 | 2.64 | | | | | | No Effect |
| 12 | 3 | 50 | 47 | | 1.32 | 2.64 | 5.38 | | | H | | |
| 13 | 2 | 50 | 48 | | 1.32 | 2.64 | 0.53 | 0.53 | | | | No Effect |
| 14 | 2 | 50 | 48 | | 1.32 | 2.64 | | 0.53 | | | | No Effect |
| 15 | 75 | 3 | 22 | | 1.32 | 2.64 | | 0.53 | | | H | |
| 16 | 75 | 3 | 22 | | 1.32 | 2.64 | | | | | H | |
| 17 | 75 | 3 | 22 | | 1.32 | 2.64 | 0.53 | 0.53 | | | H | |
| 18 | 75 | 3 | 22 | | 1.32 | 2.64 | | | | | H | |
| 19 | 75 | 3 | 22 | | 1.32 | 2.64 | 0.53 | 1.06 | | L | | Good |
| 20 | 37.5 | 1.5 | 61 | | 0.66 | 1.32 | 0.26 | 0.53 | | | | Good |

*Shantz's Solution
**Kallings Reagent
SA = Selective Attack
H = high
M = medium
L = low Certain variations in the basic composition of our solution are permissable. Our preferred solution is comprised by volume of 25 parts HCl and 1 part $HNO_3$, with water. Preferably the water is present in about 40 parts, but a quantity of as little as 12 parts is operable. The dilute solution is preferred because of the slower rate of attack. Greater dilution is possible but at the expense of a slowing of the rate of removal of material. Operable temperature range is 20°–65° C. although very slow reaction and incipient boiling are encountered at the respective end points.

The acids we use are reagant grade; the HCl is 36.5–38% hydrochloric acid (22° Baume), corresponding to 12 Molar or 12 Normal acid; the $HNO_3$ is 69–71% nitric acid (43° Baume), corresponding to 15.8 Molar or 15.8 Normal acid. The citric acid we use is 2-hydroxy-1,2,3-propanetricarboxylic acid in anhydrous form, having a specific gravity of 1.542 and a melting point of 153° C. The other ingredients are of technical grade or better.

Ferric chloride, hydrous copper sulfate and sodium fluoride are preferably used although other metal chlorides, metal sulfates and alkali metal fluorides may be substituted therefor, as they are commonly known.

We have performed some experiment and have related experience which leads us to the following general statement of our invention's useful ranges. For 100 volume percent (v/o) of solution, there should be 32.5–85 v/o HCl. Preferably, to this is added 40 ml/l $HNO_3$
2.25 g/l $CuSO_4$ (0.0141M/l $SO_4^-$)
1.76 g/l $FeCl_3$ (0.0326M/l $Cl^-$)
0.704 g/l NaF (0.0168M/l $F^-$)
1.41 g/l Citric acid (0.0073M/l)
balance, to make 100 v/o $H_2O$ where M refers to moles and liters refers to the number of liters of HCl. All the added ingredients can vary by about ±13 individually, which variation is reflected in the recitation of ingredients in the foregoing Disclosure of Invention section. Preferably HCl v/o is 32–43 to give steady and controllable milling at a rate of about 0.013 mm/hr. Faster but still uniform milling of about 0.1 mm/hr is obtainable with 65–85 v/o HCl.

For flaw detection, our invention is utilized by taking a piece of IN-100 alloy, cleaning it conventionally; contacting the surface with the chemical solution we describe herein for a period of time sufficient to remove the damaged surface layer; rinsing and drying the surface; and thereafter examining the surface with known penetrant inspection techniques, as mentioned in the Background section. The contacting with the solution may be carried out by immersion, spraying, and other processes. The amount of material typically removed will be 0.003–0.015 mm. Repetitive tests with different amounts of removal will easily show when no further flaws are being concealed by a particular preexisting surface condition.

Although this invention has been shown and described with respect to a preferred embodiment, it will be understood by those skilled in the art that various changes in form and detail thereof may be made without departing from the spirit and scope of the claimed invention.

We claim:

1. The method of chemically milling the surface of a nickel superalloy workpiece having a composition which is essentially IN-100 alloy which comprises contacting the alloy with an aqueous solution consisting essentially by volume percent of 32.5–85 hydrochloric acid, the solution containing as ingredients proportioned on the volume of hydrochloric acid, 35–45 ml/l nitric acid; 0.0122–0.0160M/l metal sulfate ion; 0.0283–0.0369M/l metal chloride ion; 0.0146–0.0190M/l metal fluoride ion; and 0.0063–0.0083M/l citric acid.

2. The method of claim 1 wherein the solution ingredients include ferric chloride, copper sulfate and sodium fluoride.

3. The method of claim 1 wherein the volume percent of hydrochloric acid is 32–43.

4. The method of claim 1 wherein the volume percent of hydrochloric acid is about 37.5 percent.

5. The method of claim 2 wherein the solution contains about 40 ml/l concentrated nitric acid, 2.3 g/l $CuSO_4$, 1.8 $FeCl_3$; 0.7 g/l NaF and 1.4 g/l citric acid, all said ingredients proportioned on the volume of hydrochloric acid.

6. The method of claim 1 which comprises maintaining the workpiece surface and solution at a temperature of 20°–65° C.

7. In the method of inspecting an IN-100 superalloy workpiece for surface flaws using a surface penetrant, the improvement which comprises first chemical milling the workpiece surface according to the method of claim 1, to thereby remove a small portion of the surface of the workpiece.

* * * * *